United States Patent [19]

Kishimoto et al.

[11] 4,154,807

[45] May 15, 1979

[54] PROCESS FOR THE PRODUCTION OF CARBON FIBERS

[75] Inventors: Soichiro Kishimoto; Isamu Obama, both of Okayama, Japan

[73] Assignee: Japan Exlan Company Limited, Japan

[21] Appl. No.: 884,183

[22] Filed: Mar. 7, 1978

[30] Foreign Application Priority Data

Mar. 23, 1977 [JP] Japan ..... 52-32524

[51] Int. Cl.[2] ..... C01B 31/07

[52] U.S. Cl. ..... 423/447.4; 264/29.2; 423/447.5; 423/447.6

[58] Field of Search ..... 423/447.4; 264/29.2; 8/115.5; 425/447.5

[56] References Cited

U.S. PATENT DOCUMENTS

| | | | |
|---|---|---|---|
| 3,622,658 | 11/1971 | Nakagawa et al. | 8/115.5 |
| 3,728,072 | 4/1973 | Orito et al. | 8/115.5 |
| 4,001,382 | 1/1977 | Matsumura et al. | 8/115.5 |
| 4,024,227 | 5/1977 | Kishimoto et al. | 264/29.2 |

FOREIGN PATENT DOCUMENTS 49-33719 9/1974 Japan.

*Primary Examiner*—Jay H. Woo

*Attorney, Agent, or Firm*—Wenderoth, Lind & Ponack

[57] ABSTRACT

Carbon fibers having excellent physical properties and satisfactory quality uniformity are produced in an industrially advantageous manner by heat-treating acrylonitrile filaments so prepared that a specified amount of the sulfonic acid groups (—$SO_3H$) which have been introduced into the fiber is converted to its salt form (—$SO_3X$) and that the degree of filament separability of the spun fiber-bundle traveling through the heat stretching step is maintained within a specified range.

11 Claims, No Drawings

PROCESS FOR THE PRODUCTION OF CARBON FIBERS

BACKGROUND OF THE INVENTION

1. Field of the Invention

The present invention relates to a process for producing carbon fibers (including graphite fibers) from acrylonitrile fibers. More specifically, the invention relates to a process for producing carbon fibers having excellent physical properties and satisfactory quality uniformity by the steps comprising:

a. forming a spun fiber bundle by spinning an acrylonitrile polymer containing at least 90 mole % acrylonitrile and 0.01 to 1.0 mole % $SO_3H$ groups and wherein at least 5% of the $SO_3H$ groups in the spun fiber bundle are converted to $SO_3X$ groups, wherein X is a monovalent metal cation or ammonium ion;

b. heat-stretching the spun fiber bundle of step (a) under conditions wherein the coefficient of filament seperability of the spun fiber bundle in said heat-stretching step is maintained within the range of 1.1 to 4.0, said coefficient of filament separability of the spun fiber bundle being:

$$\frac{\text{the maximum width of the spun fiber bundle in the heat-stretching step}}{\text{the maximum width of the spun fiber bundle after heat-stretching in stationary water in a tension-fixed state,}}$$

and then c. carbonizing or carbonizing and then graphitizing the filament of step (b).

2. Description of the Prior Art

It is already known to obtain carbon fibers which are excellent for use in reinforcing materials, exothermic elements, heat-resisting materials, etc. by heating an acrylonitrile fiber in an oxidizing atmosphere at 200° to 400° C. so as to form a cyclized structure in the fiber and carbonizing the cyclized fiber in a non-oxidizing atmosphere at a higher temperature (normally above 800° C.).

However, the so-called thermal stabilization step, which is the step of forming naphthyridine rings in the acrylonitrile fiber by heat-treating the fiber in an oxidizing atmosphere, is a very important step that governs the physical properties of the carbon fiber, the final product. It has been thought that this step requires a heat-treating operation under tension for a long period of time, and this has been the cause of the low productivity of carbon fibers.

A high-temperature thermal stabilization or a sharp temperature elevation is employed in order to heighten the productivity of carbon fibers. However, in either case, abrupt reactions such as intermolecular cross-linking and intramolecular cyclization will occur at a temperature about the exothermic transition point of the fiber. Accompanied with such reactions, local accumulation of heat takes place which causes an uneven reaction to produce a pitch-like or tar-like substance. Such a substance causes mutual adhesion of filaments or exerts a bad influence on the physical properties of the carbon fiber, for example a decrease in mechanical strength.

Therefore, various processes have been proposed to accelerate the cyclization reaction so that thermally stabilized fibers can be obtained in a short time, for example introduction of a cyclization-accelerating agent into acrylic fibers or introduction of nitrogen monoxide or hydrochloric acid gas into the oxidizing atmosphere. Both means are indeed effective in shortening the heat-treating time, but have not been satisfactory enough to improve the physical properties of carbon fibers. In addition, these methods involved a cost disadvantage in that an additional equipment investment is required for the disposal of the harmful gases.

As an alternative, a method has been attempted to employ, as the precursor fiber, an acrylonitrile copolymer fiber copolymerized with a carboxyl group (-COOH) containing unsaturated monomer. However, it is the present situation that these methods have not been successful to impart sufficient physical properties to the resulting carbon fibers, although heat-treating time can be shortened to some extent by the acceleration of the condensation cyclization by heating.

Statement of the Invention

In the light of such a situation, we have researched intensively to overcome the above-mentioned disadvantages and to obtain, industrially advantageously, carbon fibers having excellent physical properties. As a result, we have found that, by using as the precursor fiber, an acrylonitrile fiber, of which a specified amount of sulfonic acid groups connected to the fiber-forming polymer has been converted to its salt form ($SO_3X$) and of which the degree of filament separability of the fiber-bundle traveling through the heat-stretching step has been regulated within a prescribed range, and by heat-treating said fiber, heat-treating time can be shortened and extremely high-strength and high-elasticity carbon fibers can be produced industrially.

The main object of the invention is to obtain carbon fibers having excellent physical properties, in an industrially advantageous manner.

Another object of the present invention is to enable a rapid and uniform thermal stabilization reaction and to obtain flexible, high-quality carbon fibers which are free from fusion-adhesion among filaments, by using as the precursor fiber for forming carbon fibers, an acrylonitrile fiber which contain sulfonic acid groups and a specified amount of its salt form and whose the degree of separability among filaments is maintained in a good state.

The objects of the present invention will become apparent from the following concrete explanation of the invention.

The above-mentioned objects of the present invention are attained by heat-treating, in the usual way to carbonize or graphitize, an acrylonitrile fiber so prepared that at least 5 mole % of the sulfonic acid groups of a spun fiber-bundle obtained by spinning an acrylonitrile polymer containing, combined therewith, more than 90 mole % acrylonitrile and sulfonic acid groups, is replaced by a monovalent cation metal or ammonium ions, and that the coefficient of filament separability (defined by the formula given below) in the heat stretching step of the fiber-bundle obtained by spinning said polymer is maintained within the range of from 1.1 to 4.0.

Coefficient of filament separability of the spun fiber-bundle $$= \frac{\text{Maximum width of the spun fiber-bundle in heat stretching step}}{\text{Maximum width of the spun fiber-bundle after heat stretching,}}$$

in stationary water in a tension-fixed state. Thus, the present invention is characterized in using, as the precursor fiber for heat-treatment, an acrylonitrile fiber containing, combined therewith, sulfonic acid groups ($-SO_3H$) and its salt form ($-SO_3X$) and which is maintained in a very good state in respect to the separability among single filaments of the fiber-bundle in the heat-treating bath. By following this process, the individual surfaces of single filaments forming the fiber-bundle and their internal portions will undergo uniform chemical and physical treatment. When the acrylonitrile fibers thus uniformly treated are supplied to the subsequent heat treatment step, the individual, single filaments forming the fiber-bundle can be subjected to uniform cyclization reaction or cross-linking reaction, namely the filaments can be uniformly heat-treated. Therefore, this enables one to employ a condition of high-temperature thermal stabilization or a sharp temperature elevation, thus making it possible to shorten the heat treatment time. In addition, since this can also prevent the generation of foreign substances such as pitch or tar occurring in the heat treatment step, it has become possible to produce carbon fibers having uniform physical properties, remarkably improved in strength and elasticity.

Description of Preferred Embodiments

The term "acrylonitrile fibers" when used in the present invention means those fibers produced from an acrylonitrile polymer containing, combined therewith, more than 90 mole % acrylonitrile and further containing, combined therewith, 0.01–1.0 mole %, preferably 0.03–0.5 mole %, of sulfonic acid groups, by a conventional spinning process, for example wet-spinning process, dry-spinning process, dry-wet-spinning process (a spinning process in which a spinning solution is extruded through spinning orifices into air or an inert gas which is non-coagulating gas for the spinning solution), etc.

The introduction of sulfonic acid groups into the acrylonitrile polymer is performed by using, as the copolymer component, an unsaturated sulfonic acid, for example vinylsulfonic acid, allysulfonic acid, methallylsulfonic acid, p-styrenesulfonic acid, etc.) or by using, as a component of the polymerization initiator, a reductive sulfoxy compound such as a sulfite or by using a chain transfer agent such as $SO_2$, in order to introduce sulfonic acid groups into the polymer molecule or at a molecular terminal.

Also, in addition to acrylonitrile and a sulfonic acid group-containing compound, other unsaturated monomers may be copolymerized as required. Such unsaturated monomers include well-known ethylenically unsaturated compounds such as allyl alcohol, methallyl alcohol, oxypropionacrylonitrile, methacrylonitrile, α-methyleneglutaronitrile, isopropenyl acetate, acrylamide, dimethylaminoethyl methacrylate, methyl acrylate, methyl methacrylate, vinyl acetate, allyl chloride, etc.

The acrylonitrile polymers are generally produced by a known polymerization system such as solvent polymerization system, bulk polymerization system, emulsion polymerization system or suspension polymerization system. As the solvent upon producing acrylonitrile fibers from such a polymer, there are used organic solvents such as dimethylformamide, dimethylacetamide, dimethyl sulfoxide, etc.; and inorganic solvents such as nitric acid, aqueous solutions of zinc chloride, aqueous solutions of thiocyanate, and the polymer is spun into fibers in the usual way.

In such a fiber production process, the acrylonitrile fiber containing sulfonic acid groups ($-SO_3H$) and its salt form ($-SO_3X$) in a specified ratio can be obtained in various ways. In one such method for example, when using an acrylonitrile polymer copolymerized with an unsaturated sulfonic acid as previously mentioned, the fibers obtained from said polymer are treated with an aqueous solution containing monovalent cation metal or ammonium ions. However, if only an acrylonitrile fiber is obtained by any method, of which 5 mole % of the terminal hydrogen of sulfonic acid groups is finally replaced with a monovalent cation metal or ammonium ion, such a fiber can be effectively used as fiber to be provided for the present invention. A particularly preferred method of producing the fiber to be used for the present invention is to treat gel fibers in a water-swollen state obtained by spinning from an acrylonitrile polymer into which sulfonic acid groups have been introduced by any suitable method, with an aqueous solution containing a monovalent cation metal or ammonium ions, in order to convert part of the sulfonic acid groups into its salt form. The treating condition is greatly different depending on the type of the solvent used for the formation of the fibers, the kind of the cation to be replaced, the molecular orientation of the gel fibers, etc., and it is difficult to limit it definitely. Anyway, it is necessary that at least 5 mole % of the sulfonic acid groups ($-SO_3H$) contained in said fiber should be converted to the salt form ($-SO_3X$). With fibers containing salt-form-converted sulfonic acid groups in an amount out of this range, it is difficult to provide excellent, high-quality carbon fibers and it is impossible to sufficiently attain the objects of the present invention. The above-mentioned gel treatment (the treatment of gel fibers with a specific cation-containing aqueous solution) can be done in any time point if the fibers are before the drying treatment after spinning. However, the objects of the present invention can be effectively attained by performing it preferably after spinning and washing.

In the fiber production process, the acrylonitrile fiber according to the present invntion, of which the coefficient of filament separability of the fiber-bundle traveling through the heat stretching bath is specified, can be obtained by heat-treating the fiber-bundle in a water bath at a temperature from 30° to 100° C., in a tensioned state, after spinning and immediately before heat-stretching.

The adjustment of the coefficient of filament separability of the spun fiber-bundle is performed, as previously mentioned, by regulating the temperature of the water bath treatment which is performed in a tensioned state of the fiber-bundle immediately before heat stretching. However, the selection of the temperature to obtain the desired coefficient of filament separability of 1.1 to 4.0 in the heat-stretching bath depends on process factors, i.e. the combination of: the viscosity of the spinning solution upon spinning, the ratio of cold stretching, the temperature of water washing, the pH of the treating solution upon gel treatment after water washing, the pH of the solution upon heat treatment, the temperature of the stretching bath, stretching ratio, and when the above-mentioned dry-wet-spinning process is employed, the space interval between the extrusion surface of the spinning orifices and the surface of the coagulating liquid, etc. For example, when the temperature of the spinning solution is low, the temperature of the warm water treatment should be low, and when the cold stretching ratio is high, the temperature of the water treatment should be preferably low, but the temperature of the warm water should be finally maintained within the range of from 30° to 100° C. In addition, the concrete conditions of the process factors should be varied depending on the properties (molecular weight, composition, etc.) of the polymer to be used, the solvent and the spinning process. In one example, in dry-wet-spinning using sodium thiocyanate, the process conditions should be decided by suitably combining the following parameters:

- the temperature of the spinning solution: 60°-85° C. (preferably 65°-75° C.),
- the space interval between the extrusion surface of the spinning orifices and the surface of the coagulating liquid: 1.5-8 mm (preferably 2-6 mm),
- the cold stretching ratio: 1.05-2 times (preferably 1.2 to 1.7 times),
- the water washing temperature: 0°-50° C. (preferably 15°-35° C.),
- the pH of gel fiber treatment: 0.8-3.5 (preferably 1.8-2.5),
- the pH of heat stretching: 2.7-6.0 (preferably 3.5-4.5)
- the heat stretching temperature: 90°-100° C. (preferably 95°-99° C.), and
- the heat stretching ratio: 1.5-8 times (preferably 2-4 times). Anyway, it is necessary for the acrylonitrile fiber used in the present invention to be controlled to have a coefficient of filament separability of the spun fiber bundle of 1.1-4.0. When the coefficient of separability of the spun fiber-bundle is less than 1.1, the surfaces of the single filaments composing the spun fiber-bundle and their inner portions cannot undergo uniform chemical and physical treatment. Therefore, the resulting fiber-bundle is not uniform chemically and physically, and in addition, because of the low temperature of the warm water treatment before heat stretching, the crystallization does not proceed and the filaments are not highly oriented. Thus finally, it becomes difficult to produce carbon fibers having excellent physical properties and high quality. On the other hand, when the coefficient of filament separability exceeds 4.0, the filament separation in the heat stretching bath will proceed to an excessive extent, causing entanglement of the single filaments composing the fiber-bundle. This causes disadvantages such as single filament breakage of the spun fiber-bundle and lowering in operability. Also, the high temperature of the warm water treatment before heat stretching brings about excessive crystallization which lowers stretchability, thus lowering the operability.

The above-mentioned coefficient of filament separability of the spun fiber-bundle is defined by measurement by the following method:

An acrylonitrile spinning solution prepared by the usual method is divided into two portions. As for the first portion, after passing through the steps of spinning, cold stretching, water-washing, gel treatment and heat stretching, the resulting fiber-bundle is once removed out of the treating system and then is again introduced in a tension-fixed state into the heat stretching bath. As regards the other portion, after being subjected to the steps of spinning, cold stretching, water-washing and gel treatment under the same conditions as the first one, the resulting fiber-bundle is introduced into the heat stretching bath and is then led to the subsequent steps (for example drying, heat treatment, etc.) to form the final fiber. Now when the maximum width of each spun fiber-bundle in the heat stretching bath is expressed by 1 and 1' respectively (1 being in a non-tension-fixed state and 1' being in a tension-fixed state), then the coefficient of filament separability of the present invention is defined as follows:

$$\text{Coefficient of separability of the spun fiber-bundle} = 1/1'$$

The acrylonitrile fiber prepared under specified conditions of the process steps (prepared after passing through spinning, cold stretching, gel treatment, warm water treatment and heat stretching) is subjected, as required, for example to an additional stretching treatment in pressurized steam, drying-compacting treatment, relaxing heat treatment, etc., and is formed into an acrylonitrile fiber as the precursor fiber to be heat-treated.

Upon producing carbon fibers from the thus-obtained acrylonitrile fiber which contains sulfonic acid groups ($-SO_3H$) and its salt form ($-SO_3X$) in a specified ratio and which is maintained in a very good state in respect to the mutual separability of single filaments, any known conventional heat treating method can be employed. However, a heat-treating method is generally preferred which comprises a first heating step (the so-called thermal stabilization step) in which the fiber is heated at 150° to 400° C. in an oxidizing atmosphere to form a cyclized structure of naphthyridine rings in the fiber, and a second heating step in which the thermally stabilized fiber is heated at higher temperatures (generally above 800° C. and in the case of graphitization, temperatures above 2000° C.) in a non-oxidizing atmosphere or under reduced pressure to carbonize or graphitize the fiber. Although air is suitable as atmosphere for use in thermal stabilization, it is possible to employ such methods as thermally stabilizing the fiber in the presence of sulfur dioxide gas or nitrogen monoxide, or under irradiation of light. Also, among the atmospheres for use in carbonization or graphitization, nitrogen, hydrogen, helium, and argon are preferred. To obtain a carbon fiber having a better tensile strength and modulus of elasticity, it is preferable to heat the fiber under tension, as is generally known. It is particularly effective to apply tension upon thermal stabilization and carbonization or graphitization.

By empolying such process of the present invention, it is now possible to produce a high-strength and high-elasticity carbon fiber which is highly uniform in quality, at a high production efficiency and in a short time. Accordingly, the carbon fiber having such excellent properties can be advantageously used as a component for resin-reinforced composite materials to provide excellent properties, and has now come to be used in the wide field of reinforcing materials, exothermic elements, refractory materials, etc.

For a better understanding of the present invention, representative examples of the invention are set forth hereinafter. The percentages and parts in the examples are by weight unless otherwise specified.

EXAMPLE 1

A spinning solution (temperature 68° C.) was obtained by dissolving 15.5 parts of an acrylonitrile polymer (obtained by aqueous suspension polymerization using a $(NH_4)_2S_2O_8/Na_2SO_3$ redox catalyst) consisting of 98 mole % acrylonitrile and 2 mole % methacrylic acid in 84.5 parts of a 53% aqueous solution of sodium thiocyanate. After this spinning solution was once extruded into air through a spinnerette having 1200 spinning orifices each 0.25 mm in diameter, it was introduced into an aqueous 13% sodium thiocyanate solution to form coagulated filaments, the space interval between the bottom surface of the spinnerette and the liquid surface of the coagulating bath being 0.5 cm. After cold-stretching the thus obtained fiber-bundle 1.3 times, it was washed with water at 30° C. and then treated in a gel treating bath adjusted to pH 1. The fiber-bundle was further treated in gel treating bath under the various conditions shown in Table 1, respectively. Thereafter, the fiber-bundle was heat-treated under tension in a water bath at 60° C., and was further caused to pass through a heat-stretching bath while maintaining the temperature at 98° C., the pH at 4.0 and the stretching ratio at 2.4 times. The coefficient of filament separability of the spun fiber-bundle in the heat-stretching step was found to be 1.5. Thereafter, the heat-stretched fiber-bundle, after being passed through the steps of stretching in super-heated steam and drying, was formed into acrylonitrile fibers having a single filament denier of 1.3.

The acrylonitrile fibers thus produced under the various gel treatment conditions were heat-treated respectively to produce 8 kinds of carbon fibers. In this heat treatment, the fiber-bundle was heated in air by an electric furnace from 200° to 300° C. with continuous temperature elevation, spending 30 minutes, to obtain thermally stabilized fibers, which were further heated in a nitrogen gas atmosphere up to 1200° C. with continuous temperature elevation, spending 100 minutes to carbonize the fibers.

The strength and modulus of elasticity of the thus-obtained 8 kinds of carbon fibers were measured. The results are shown in Table 1. As apparent from the comparison in Table 1, it is now possible to remarkably elevate the strength and modulus of elasticity of carbon fibers by following the present invention.

Table 1

| | Gel treatment condition | | Na-exchange | Physical properties of carbon fiber | |
|---|---|---|---|---|---|
| | pH | $Na_2SO_4$ concentration (ppm) | ratio* (mole %) | Strength (kg/mm$^2$) | Young's modulus (ton/mm$^2$) |
| Present invention | 2.2 | 0 | 36 | 384 | 24.2 |
| | 2.2 | 560 | 71 | 403 | 25.0 |
| | 2.6 | 560 | 98 | 417 | 25.4 |
| | 1.5 | 0 | 5.0 | 341 | 23.3 |
| | 1.6 | 0 | 22 | 379 | 23.7 |
| | 1.5 | 560 | 17 | 368 | 24.5 |
| | 1.0 | 0 | 0 | 254 | 21.6 |
| Comparative examples | 1.2 | 0 | 3 | 290 | 22.8 |

*The ratio of conversion of the sulfonic acid groups (-$SO_3H$) into its salt form (—$SO_3Na$)

EXAMPLE 2

The same acrylonitrile polymer as in Example 1 was spun under the same spinning condition as in Example 1. The spun fiber-bundle thus obtained was then cold-stretched 1.5 times, and was washed with water at 28° C. The fiber bundle was then treated in a gel treatment bath adjusted to pH 1, and was further treated in a gel treating bath which was maintained at a pH of 2.2 and a $Na_2SO_4$ concentration of of 560 ppm. (The Na-exchange ratio at this time was 71 mole %). Thereafter, it was heated under tension under the various water bath conditions shown in Table 2, and was further caused to pass through a heat-stretching bath while maintaining the temperature at 98° C., the pH at 4.0 and the stretching ratio at 3.0 times. The measurement results of the coefficient of filament separability of the spun fiber-bundle in this heat-stretching step are as shown in Table 2. Thereafter, the fiber-bundle was treated by the same operation as in Example 1 to obtain acrylonitrile fibers having a single filament denier of 1.3.

The acrylonitrile fibers thus prepared to have different degrees of filament separability were heat-treated according to the same heat-treating condition as in Example 1 and 6 kinds of carbon fibers were obtained.

The strength and modulus of elasticity of the thus obtained carbon fibers were measured. The results are shown together in Table 2. It will be clearly understood from the comparison in Table 2 that the carbon fibers obtained by following the present invention can be improved in physical properties in comparison with conventional ones.

From the description of the Examples, it will be clearly understood that, by heat-treating an acrylonitrile fiber so prepared that a specified amount of the sulfonic acid groups (—$SO_3H$) introduced into the fiber is converted to its salt form (—$SO_3X$) and that the degree of filament separability of the spun fiber-bundle traveling through the heat-stretching step in the acrylonitrile fiber production step is maintained within a specified range, carbon fibers having excellent physical properties (strength and Young's modulus) can be produced industrially advantageously.

Table 2

| | Temperature of warm water treatment bath (° C.) | Coefficient of filament separability of spun fiber-bundle | Filament separability | Physical properties of carbon fiber | |
|---|---|---|---|---|---|
| | | | | Strength (kg/mm$^2$) | Young's modulus (ton/mm$^2$) |
| Present invention | 35 | 1.1 | Good | 354 | 24.3 |
| | 40 | 1.3 | Good | 408 | 25.0 |

Table 2-continued

| | Temperature of warm water treatment bath (° C.) | Coefficient of filament separability of spun fiber-bundle | Filament separability | Physical properties of carbon fiber | |
|---|---|---|---|---|---|
| | | | | Strength (kg/mm²) | Young's modulus (ton/mm²) |
| | 50 | 3.0 | Good | 422 | 24.5 |
| | 60 | 4.0 | Good | 397 | 25.2 |
| Comparative examples | 28 | 1.0 | Poor | 278 | 23.1 |
| | 105 (under pressure) | 5.0 | Excessive | 300 | 23.8 |

We claim:

1. A process for producing carbon fibers which comprises:

a. forming a spun fiber bundle by spinning an acrylonitrile polymer containing at least 90 mole % acrylonitrile and 0.01 to 1.0 mole % $SO_3H$ groups and wherein at least 5% of the $SO_3H$ groups in the spun fiber bundle are converted to $SO_3X$ groups, wherein X is a monovalent metal cation or ammonium ion;

b. heat-stretching the spun fiber bundle of step (a) under conditions wherein the coefficient of filament separability of the spun fiber bundle in said heat-stretching step is maintained within the range of 1.1 to 4.0, said coefficient of filament separability of the spun fiber bundle being:

$$\frac{\text{the maximum width of the spun fiber bundle in the heat-stretching step}}{\text{the maximum width of the spun fiber bundle after heat-stretching in stationary water in a tension-fixed state,}}$$

and then c. carbonizing or carbonizing and then graphitizing the filament of step (b).

2. The process for producing carbon fibers according to claim 1 wherein an acrylonitrile fiber obtained by treating gel filaments in a water-swollen state with an aqueous solution containing a monovalent cation metal or ammonium ions, is used.

3. The process for producing carbon fibers according to claim 10 wherein the acrylonitrile fiber bundle obtained in step (a) is heat-treated after spinning and in a warm water-bath immediately before step (b).

4. The process according to claim 1 wherein the heat-treated acrylonitrile fibers are thermally stabilized by being heated in an oxidizing atmosphere at a temperature of from 150° C. to 400° C. and thereafter, are carbonized or carbonized and then graphitized in a nonoxidizing atmosphere at a temperature above 800° C.

5. The process as claimed in claim 4 wherein the heat-treated acrylonitrile fibers are thermally stabilized by being heated under tension.

6. The process as claimed in claim 4 wherein the thermally stabilized fibers are carbonized or carbonized and then graphitized under tension.

7. The process as claimed in claim 4 wherein the oxidizing atmosphere is air.

8. The process as claimed in claim 4 wherein the thermally stabilized fibers are carbonized in a nonoxidizing atmosphere at a temperature of from 800° C. to 2000° C. and then graphitized in a non-oxidizing atmosphere at a temperature of from 2000° C. to 3500° C.

9. The process as claimed in claim 4 wherein the non-oxidizing atmosphere is nitrogen.

10. The process for producing fibers according to claim 3 wherein said warm water-bath heat treatment step is performed at 30° to 100° C. in a tensioned state.

11. The process as claimed in claim 1 wherein said acrylonitrile polymer to be spun contains 0.03 to 0.5 mole % $SO_3H$ groups.

* * * * *